US005839152A

United States Patent [19]

Kruskamp

[11] Patent Number: 5,839,152

[45] Date of Patent: Nov. 24, 1998

[54] APPARATUS FOR CLEANING TROWEL BLADES

[75] Inventor: Stephen L. Kruskamp, Fair Oaks, Calif.

[73] Assignee: Gene H. Howard, Orangevale, Calif.; a part interest

[21] Appl. No.: 759,330

[22] Filed: Dec. 2, 1996

[51] Int. Cl.[6] ..... A47L 13/02; B05C 17/10

[52] U.S. Cl. ..... 15/236.06; 15/236.09; 15/236.01; 15/236.08; 15/235.4; 15/235.6

[58] Field of Search ..... 15/236.01, 236.05, 15/236.06, 236.07, 236.08, 236.09, 257.05, 235.4, 235.6

[56] References Cited

U.S. PATENT DOCUMENTS

| | | | |
|---|---|---|---|
| 2,707,299 | 5/1955 | Steindorf | 15/236.09 |
| 2,861,288 | 11/1958 | Steindorf | 15/236.09 |
| 2,941,224 | 6/1960 | Hercer | 15/236.09 |
| 3,396,421 | 8/1968 | Rade | 15/236.09 |
| 4,891,859 | 1/1990 | Tremblay | 15/236.09 |
| 5,471,705 | 12/1995 | Dao | 15/236.05 |

FOREIGN PATENT DOCUMENTS

| | | | |
|---|---|---|---|
| 2182550 | 5/1987 | United Kingdom | 15/236.06 |

*Primary Examiner*—Randall E. Chin
*Attorney, Agent, or Firm*—Lothrop & West

[57] ABSTRACT

An apparatus for removing adhesive or other contaminants from a hand trowel. Two embodiments are disclosed, each including a body having a slot extending through at least a portion thereof, and through which the trowel blade is drawn for cleaning. A pair of opposing scraping blades is mounted to the body, on either side of an entry end of the slot. The blades are maintained in spaced relation, a distance approximating the thickness of the trowel blade. In one embodiment, the body includes, at one end, a handle for gripping. The underside of the body may also be attached to another blade, having a special scraping edge on its forward portion. In this configuration, the first embodiment performs yet another cleaning function, as a floor scraping tool. In the other embodiment, the body is structurally integrated with a reservoir, or trough, adapted for mounting over a portion of the lip of a bucket containing adhesive. The other embodiment also includes a separate scraping knife, for cleaning the planar underside of the trowel. The trough contains and confines the scraped-off adhesive, to prevent fouling of the fresh adhesive in the bucket.

35 Claims, 4 Drawing Sheets

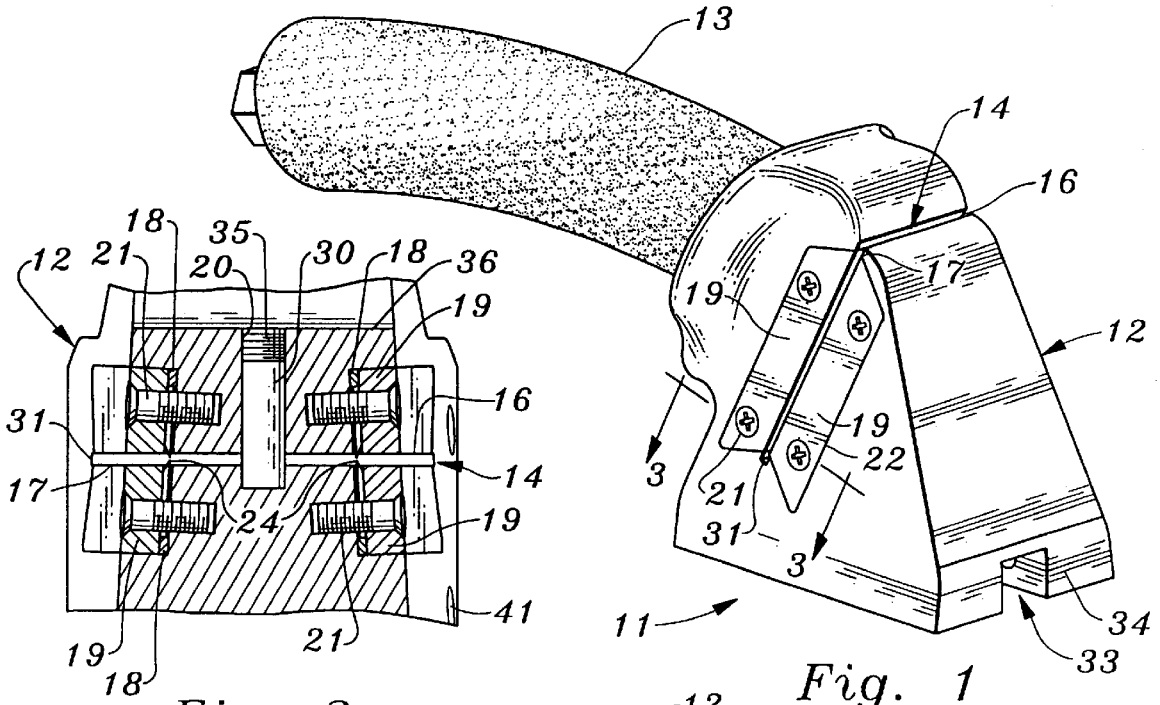
Fig. 1
Fig. 3
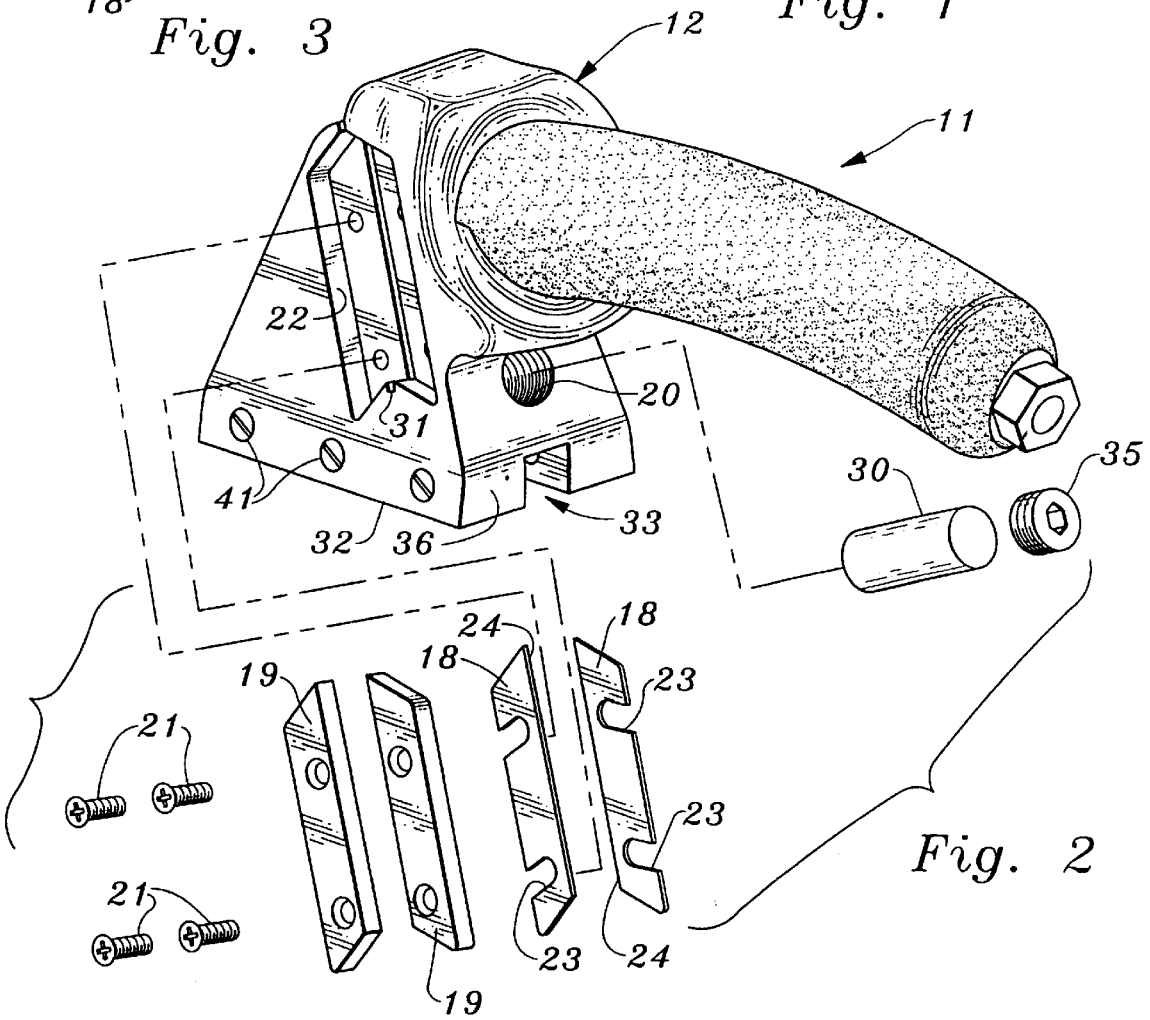
Fig. 2

APPARATUS FOR CLEANING TROWEL BLADES

BACKGROUND OF THE INVENTION

1. Field of the Invention

The invention pertains to tools and methods used to install floor covering, such as adhesive-applied vinyl flooring. More specifically, the invention relates to devices which facilitate on-the-job cleaning of hand trowels, used by installers to spread and apply adhesive to floors. The invention herein is utilized continuously during the adhesive application job, to remove partially dried, hardened, and contaminated adhesive from the trowel. Contamination of the fresh adhesive is thereby minimized, and the quality of adhesion between the floor and the covering is enhanced.

2. Description Of The Prior Art

Vinyl flooring is installed by first spreading a fast-drying adhesive over an underlying floor surface, using a hand trowel. The trowel blade includes a plurality of small teeth, defining notches therebetween, along its edges. These notches are sized and configured to distribute the adhesive evenly, in a predetermined amount and pattern, as the trowel is drawn across the floor. Next, the vinyl flooring material is laid smoothly and progressively over the adhesive and compressed against the floor, removing air bubbles and forming a tight, adhesive bond therewith.

Contamination of the fast-drying adhesive has long been a problem associated with the installation of such vinyl flooring. During application of the adhesive, the teeth of the trowel scrape across the floor, dislodging and picking up debris from the floor surface. This debris may include small pieces of material from a wood subfloor, a concrete slab, filler, or remains of "old" floor covering. Some of the debris becomes lodged in the notches between the trowel teeth, adversely affecting the amount and the pattern of the applied adhesive. The clogged trowel notches do not freely pass the adhesive, so that manufacturer's specifications for the proper amount of adhesive are not met. Other articles of debris become entrained in the adhesive actually applied to the floor, reducing its bonding efficacy.

Contamination of adhesive is further spread by inadvertently mixing partially dried, or "set up" adhesive containing the debris, with fresh adhesive. Before scooping a new portion of adhesive for application, floor installers often clean their trowels by scraping the trowel blade on the lip of the adhesive bucket. The contaminated, partially dried adhesive either falls or eventually runs down the inner sidewall of the bucket, intermixing with the fresh adhesive material. This begins a chemical process which causes the new adhesive to deteriorate prematurely, and lose its full adhesive strength.

The reduced amount and contaminated nature of the adhesive result in many undesirable defects in the new vinyl floor covering installation. These defects include: raised bubbles, opened seams, curled edges, weakened coverings detaching from a wall, and discoloration of the vinyl material.

The need exists, then, for a device providing effective cleaning of trowel blades used for applying adhesive materials to floors. The need also exists for a device which can be used both for scraping and dislodging floor debris, and for cleaning trowel blades. The need further exists for a device which may conveniently be attached to the lip of an adhesive bucket, and includes both trowel cleaning structures and a reservoir, or well, to collect and store old or contaminated adhesive which has been removed from a trowel.

SUMMARY OF THE INVENTION

The invention disclosed herein is a trowel cleaning tool, used by floor installers to remove partially dried and contaminated adhesive from their trowels. One embodiment of the trowel cleaning tool assumes a handtool configuration, held by the installer in one hand while the other hand is used to apply the adhesive with the trowel. In this manner, the handtool is conveniently available for the installer, to be used concurrently as the adhesive is being applied.

The handtool includes a body having a narrow, elongated slot, sized and configured to accommodate a lateral edge portion of the trowel blade. Opposing, parallel cleaning blades are included within the slot, arranged in spaced relation a distance slightly greater than the thickness of the blade. A grip or handle extends from the tool body, allowing the installer to grasp the tool firmly during the trowel cleaning process.

When the trowel used for applying adhesive becomes fouled with old adhesive and debris, the rearward, lateral edge portion of the blade is inserted into the slot of the handtool. Holding the handtool firmly, the installer then draws the trowel toward him, until the entire extent of the trowel blade's lateral edge has passed through the slot. The cleaning blades scrape upper and lower faces of the trowel, and the bottom of the slot scrapes the notches clean. Any debris or old adhesive on the blade edge and within the notches is thereby removed. The spacing between the cleaning blades is adjustable, to accommodate different thicknesses of trowel blades and to compensate, over time, for wear. The blades are also removable, for cleaning and replacement as required.

A bottom portion of the handtool body may be mounted to a trowel blade, providing additional advantages and features. A conventional trowel blade, having a replaceable or interchangeable handle feature, typically includes a detachable mounting system for the trowel handle. The present invention may be adapted to that detachable mounting system, allowing a conventional trowel to be retrofitted with the cleaning feature of the handtool.

It is not uncommon for the installer to encounter small pieces of debris or loose filler material remaining on the floor, even as the adhesive is being applied. To deal effectively with that problem, the present invention may also be mounted to a trowel blade of special design. The special blade has a sharp knife on its forward end, allowing the handtool and blade combination to be used as a scraper to clean debris from floor areas. The forward, lateral portions of the special blade may also be provided with recesses, allowing the scraper knife to enter and clean otherwise inaccessible areas.

A second embodiment of the invention assumes the configuration of a trowel cleaning accessory, having a base adapted for mounting over the rim of a bucket containing the flooring adhesive. The base includes a body portion having an elongated slot similar to that used in the cleaning tool of the first embodiment. A separate, horizontally oriented and upwardly facing blade is provided on the base, to allow the installer to scrape the lower face of the blade. The base also includes a reservoir, or well area, positioned beneath the entry end of the slot and underneath the scraper blade, to intercept and store, any old adhesive and debris removed from the blade. In this manner, the trowel may be cleaned without contaminating the fresh adhesive remaining in the bucket.

BRIEF DESCRIPTION OF THE DRAWINGS

FIG. 1 is a right front perspective, particularly showing the body portion of the handtool of the first embodiment;

FIG. 2 is a right front perspective, particularly showing the handle portion of the first embodiment and an exploded view of a sub-assembly, including the cleaning blades, the blade holders and the holder screws;

FIG. 3 is a cross-sectional view, taken on the line 3—3, shown in FIG. 1;

DETAILED DESCRIPTION OF THE PREFERRED EMBODIMENT

Figure 4:
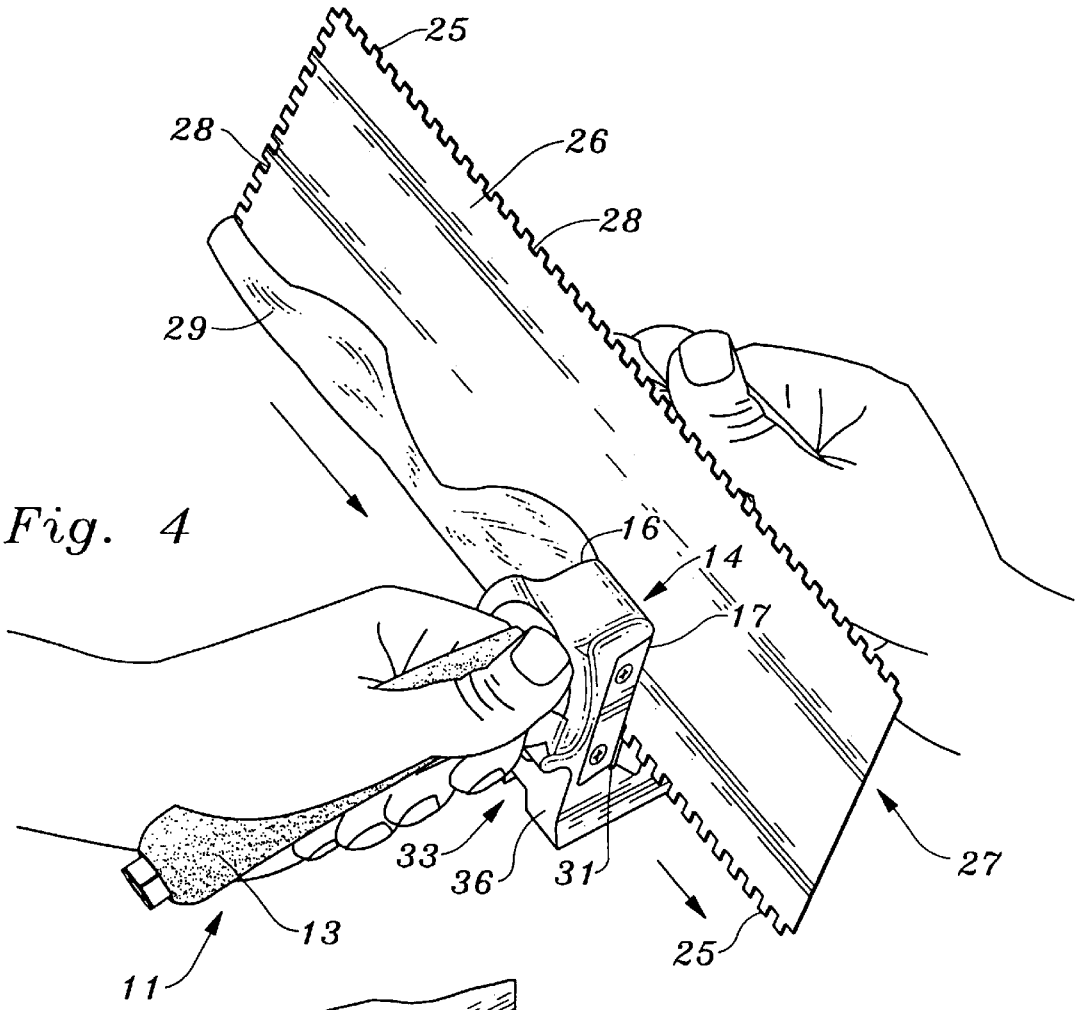
FIG. 4 is a perspective view, showing the handtool in actual use, in which a trowel is being drawn for cleaning, from an entry side to an exit side of the handtool's cleaning slot.

Turning now to FIG. 1, the first embodiment of the invention, a trowel cleaning handtool 11, includes a body 12 and a handle 13. The body may be constructed from aluminum, or another lightweight material of suitable strength. The configuration of the body is not critical, although the sloped sidewalls and the flat bottom portion shown in FIG. 1 do have some advantages, as will be discussed herein. Preferably, the handle 13 includes a rubber or dense foam outer coating, to provide a resilient gripping surface.

A slot 14 extends through a portion of body 12, and includes a blade entry side 16 and a blade exit side 17. The slot 14 is oriented and configured in a manner to facilitate the trowel cleaning operation using a hand-held tool. It should be noted that the plane of the slot is vertically and outwardly offset, in a direction away from the handle 13. This orientation allows the installer using the handtool, to grasp the handle and perform the cleaning operation more effectively than a vertical orientation for the slot would.

In addition, the bottom of the slot 14 has a longer travel path than the top of the slot. Put another way, the outer edges of the slot, both at the entry side 16 and at the exit side 17, are upwardly and inwardly converging. This edge orientation is also reflected in the generally wedge-shaped the configuration of body 12. As will be discussed more fully herein, placing the plane of blade entry side 16 at a slant, or oblique orientation with respect to the bottom of the slot, reduces the effort required to draw the trowel to be cleaned through the handtool 11.

The handtool as disclosed herein preferably includes a pair of cleaning blades 18 and a pair of blade holders 19, both at the entry side 16 and at the exit side 17 of the slot. When constructed in this manner, the handtool may be used both by right-handed and left-handed installers, with equal ease. The height of the cleaning blades 18 is generally coextensive with the depth of slot 14. Holder screws 21 are provided to secure blades 18 and holders 19 within a recess 22 in the sidewall of body 12. In that manner, the outer surfaces of holders 19 are flush with the sidewall of body 12.

U-shaped cutouts 23 are included in the cleaning blades, allowing lateral adjustment of each blade with respect to an opposing blade, and with respect to the slot 14. The cleaning blades are arranged in parallel, spaced relation, on either side of the slot. The distance between adjacent edges 24 of the cleaning blades is such that a blade 26 of a trowel 27, can pass edgewise, snugly therethrough.

Trowel blade 26 typically includes a plurality of teeth 25 and notches 28 around its outer edge, or periphery. The notches are designed to allow the passage of adhesive material 29 therethrough, as the installer scrapes the lateral edge of the trowel over the subfloor. As a consequence, adhesive is applied to the subfloor in the prescribed amount and in the proper pattern, to ensure a strong bond between the subfloor and the vinyl floor material. When these notches become clogged with flooring debris, or when the fast-setting adhesive becomes partially dried and hardened on the blade, the trowel blade should be cleaned. Effective cleaning of the blade reopens all of the notches and prevents old adhesive from contaminating both the flooring adhesive and the fresh adhesive remaining in the supply bucket.

As shown in FIG. 4, a right-handed installer grips the handle 13 with his left hand, and holding the trowel 27 with his right hand, inserts the rear end of blade 26 into the entry side 16 of the slot 14. Then, the trowel blade is drawn entirely through the handtool 11, until the front end of the blade clears the exit side 17. During this process, the adhesive 29 on the upper and lower faces of the lateral edge of the trowel blade is scraped off by cleaning blades 18. At the same time, the notches 28 are scraped clear of debris, within the lower edge 31 of the slot. To protect the teeth 25 from undue abrasion and wear, a partially threaded bore 20 is provided in the body to accommodate a DELRON or plastic rod 30. A threaded plug 35 secures rod 30 within bore 20. Bore 20 extends from the rear exterior of the body slightly across the far side of slot 14, and is positioned so that its upper portion is slightly above the lower edge of the slot. Thus, the upper surface of the rod is similarly located within the median portion of the slot, to prevent metal to metal contact between the lower edge of the slot and the trowel teeth. In the event that the body is constructed from plastic or other another synthetic material, this sacrificial rod would not be necessary.

A collection bucket, or other suitable container (not shown), is preferably placed beneath the handtool during the cleaning process, to catch the old adhesive and debris removed from the trowel. If necessary, this process may be repeated for the other lateral, or side edge of the trowel, and for the front end of the trowel as well.

If the installer is left-handed, the cleaning operation is simply reversed. The handle 13 is grasped by the right hand of the installer, and holding the trowel with his left hand, the blade is inserted into the entry side of the slot 14. Then, the same cleaning operation as described above is undertaken. It should be noted that for a left-handed installer, the positions of the entry side 16 and the exit side 17 are reversed from those shown in the drawings. However, because the embodiment of the invention shown in the drawings includes two complete sets of blades, located on both entry and exit sides of the slot, it can be used both by right-handed and left-handed persons. In the event that the handtool is to be used only by a person having one hand preference or the other, only one set of cleaning blades on the selected entry side of the slot, is required for use of the handtool 11.

Preferably, the body 12 includes a flat bottom portion 32, having an elongated, median groove 33 or receptacle extending from a forward end 34 to a rearward end 36 of the body 12. Bottom portion 32 and groove 33 are configured to mate with corresponding structures on a handtool trowel blade 37. Trowel blade 37 may be of conventional design, as certain prior art trowel handles are detachable and modular, designed for use with a variety of replaceable blades. Various means of detachably coupling the blade and the handle are used, including tapered sliding structures and slotted openings for receiving buttons.

Thus, despite the fact that the groove 33 shown in the drawings is elongated and generally rectangular in cross-section, it can be any desired size or configuration, depending upon the design of the prior art blade to which it attaches. In this manner, a prior art trowel blade may conveniently be modified or retrofitted with the handtool of the present invention.

Figure 5:
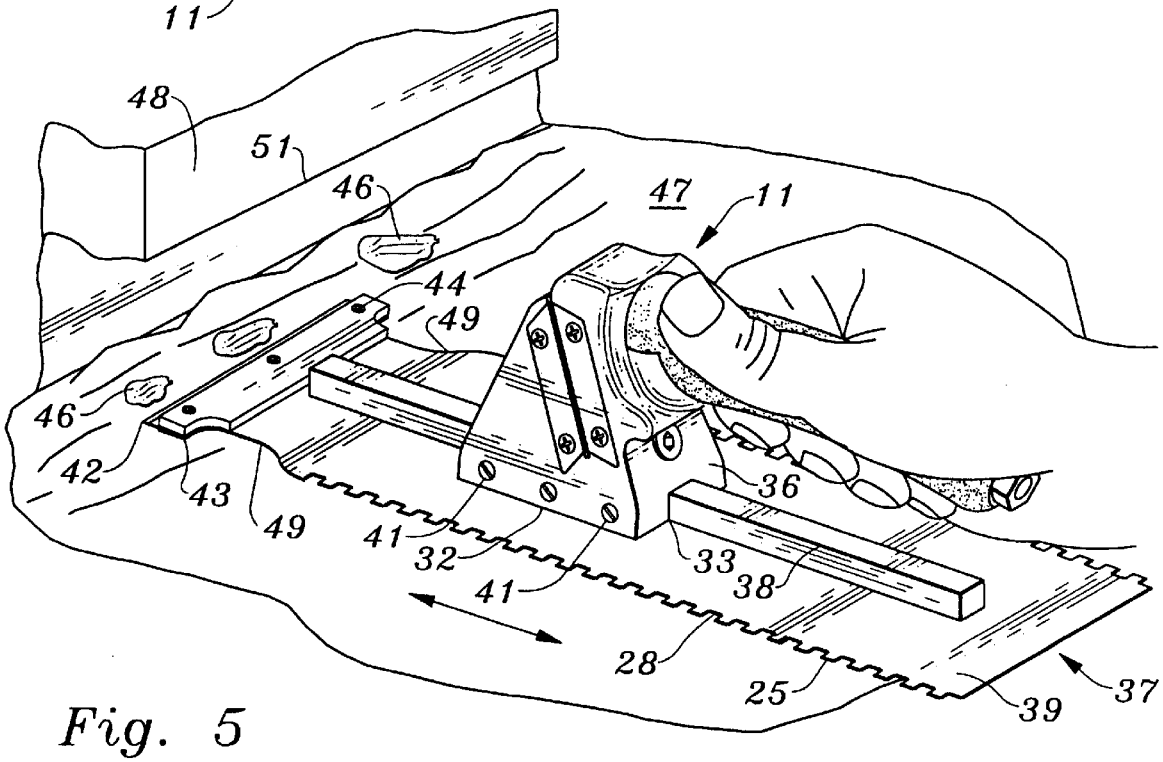
FIG. 5 is a perspective view of the first embodiment of the invention attached to a trowel blade having a forward scraping edge, the combination being used to scrape debris from the floor area beneath the lower edge of a gypsum wallboard.
Figure 6:
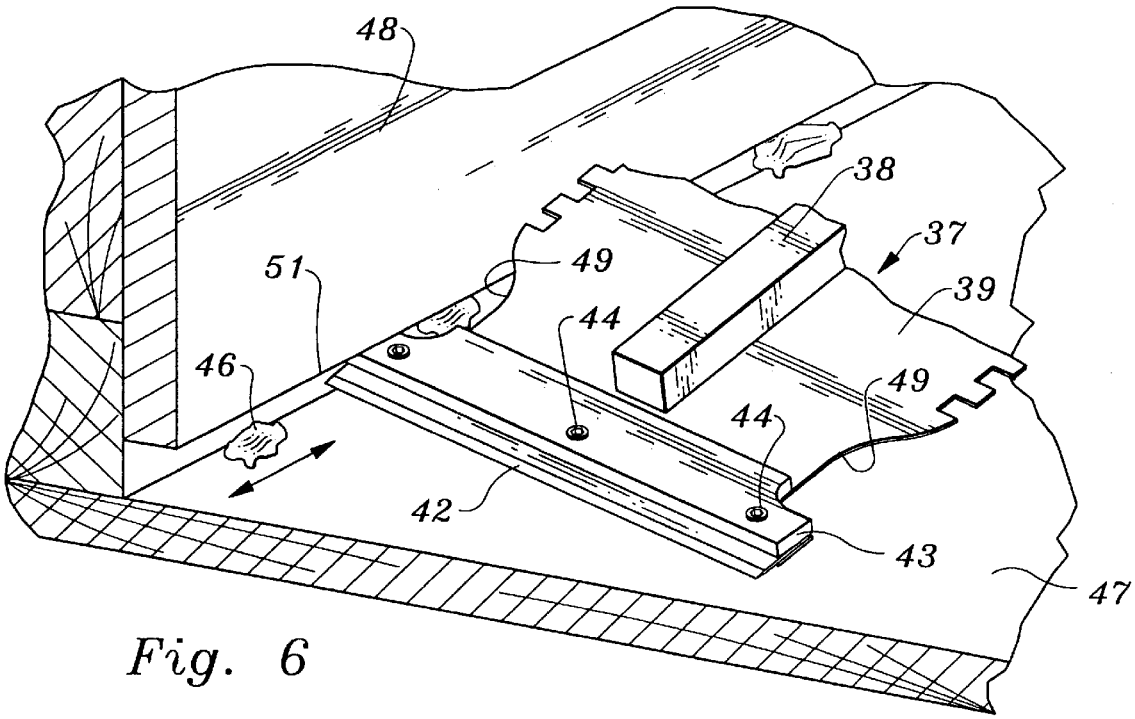
FIG. 6 is a perspective view of the combination of FIG. 5, showing how the recess or cutout in the forward lateral portion of the blade accommodates the protruding lower edge of the wallboard.
Figure 7:
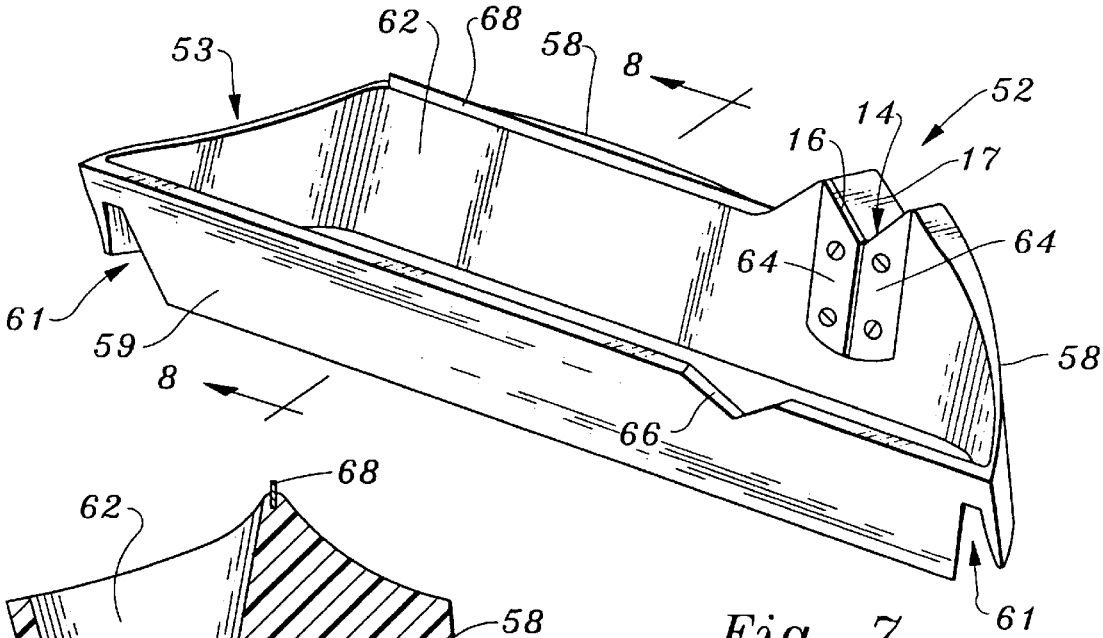
FIG. 7 is a perspective view of the second embodiment of the invention, a trowel cleaning accessory.
Figure 8:
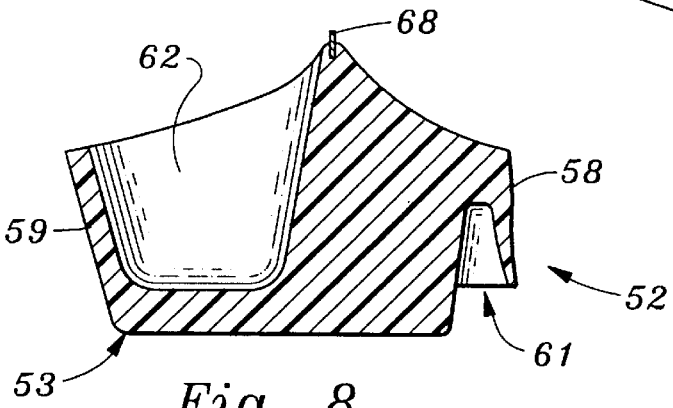
FIG. 8 is a cross-sectional view, taken on the line 8—8 shown in FIG. 7.

However, a handtool trowel blade 37 of special design is shown in FIGS. 5 and 6.

As will be discussed herein, this design provides several advantages over known prior art blades. For detachable coupling between the blade and the handtool 12, an elongated bar 38, generally rectangular in cross-section, is provided. Bar 38 is welded or riveted along the median axis of blade 37, on its upper face 39. Groove 33 slidably engages bar 38, allowing adjustable placement of the handtool along blade 37. Three screws 41 extend partially through body 12, from one side to the groove 33. Once a position for the handtool has been selected, the screws 41 are tightened to impinge on bar 38 and secure the handtool in place.

Blade 37 also includes a replaceable knife 42 on its forward end, attached by means of plate 43 and screws 44. As shown in FIG. 5, the combination of the handtool 12 and the trowel blade 37 is used to scrape debris 46 from the subfloor 47. Although the subfloor is usually prepared for the floor covering operation by removing all debris and other foreign matter, sometimes the smaller particles are missed until the installer is on the floor and in the process of applying adhesive. In this situation, the separate trowel blade 37 fitted with the knife 42 is particularly handy.

Also, areas of the floor which are relatively inaccessible using normal cleaning tools can be reached with the forwardly extending knife 42. For example, gypsum wallboard 48 is usually installed in spaced relation, usually ½" or so, from the subfloor 47. The area underneath the lower edge of wallboard 48 must be cleaned and free of all debris, so that adhesive applied to that area will form a tight bond with the vinyl flooring. Since it is difficult to access, this area poses unique problems for cleaning and clearing. The forward, lateral edges on either side of the blade 37 are provided with arcuate cutouts 49, to accommodate the lower, protruding edge 51 of wallboard 48. Thus, when the blade 37 is in a slightly raised position, as shown in FIG. 6, and the blade is being used either to scrape or clear the nearly hidden debris 46, the cutouts allow full entry of the knife 42 into the area.

A second embodiment of the invention, a trowel cleaning accessory 52, is disclosed in FIGS. 7–10. Accessory 52 includes a base 53, or body, adapted for attachment to a portion of the rim 54, or lip, of a supply bucket 56 containing fresh adhesive 57. Base 53 may be molded from plastic or other synthetic material, providing a simple and inexpensive method of manufacture.

The periphery of base 53 includes an arcuate portion 58, extending partly around the rim of the bucket, and a lineal portion 59, connecting ends of the arcuate portion, and extending across the bucket. Beneath, and coextensive with the arcuate portion 58, is a semi-circular groove 61, sized and configured to accommodate a corresponding section of rim 54. In this manner, accessory 52 is temporarily attached to bucket 56, while adhesive is applied to the subfloor.

The periphery of base 53 defines a reservoir 62, or well, sized and positioned to intercept and collect, old and contaminated adhesive 29, which is removed from a trowel 63. Trowel 63 is of conventional design, and includes the previously discussed teeth 25 and notches 28 along its lateral edges and its front edge.

Also within the arcuate portion of the base periphery, are a slot 14 and a pair of cleaning blades 64 on the entry side 16 of the slot. Cleaning blades 64 are similar to cleaning blades 18 discussed previously. The principal differences are the lack of cutouts, for adjustment, and the shape of the upper and lower portions of the blades. Also, blade holders are not used to secure the blades in the accessory 52. Lastly, it should be noted that the planar orientation of slot 14 is vertical, and that only one pair of cleaning blades is used. These differences are not critical to successful practice of the invention, and reflect only obvious design choices in simplify and adapting the cleaning blades and the cleaning slot for use with the accessory 52.

A V-shaped notch 66 is provided in lineal portion 59. The bottom edge of notch 66 is in co-planar alignment with slot 14. One purpose of notch 66 is to provide an alignment guide when first inserting the trowel for cleaning. Yet another purpose for the notch is to accommodate the trowel blade during the cleaning process, allowing a more horizontal orientation of the lateral edge than would otherwise be possible.

Figure 9:
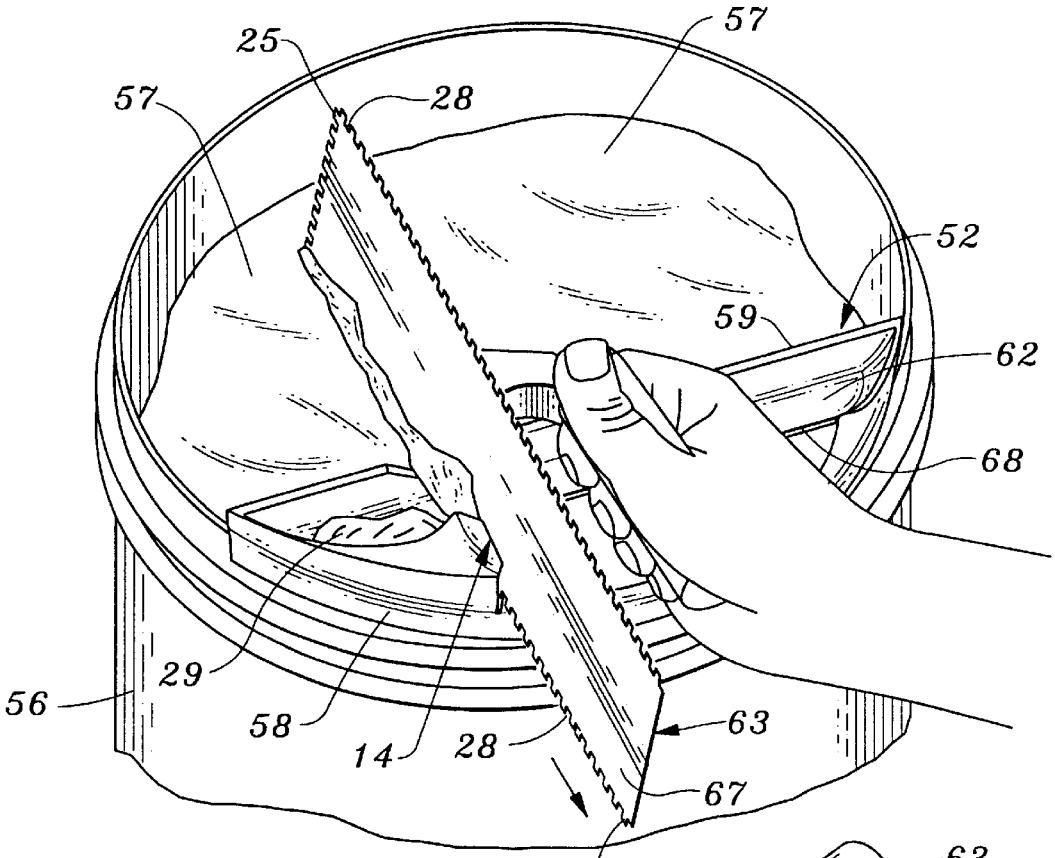
FIG. 9 is a perspective view, showing the trowel cleaning accessory mounted to the rim or lip of a bucket containing adhesive, and including a trowel being drawn through the cleaning slot.
Figure 10:
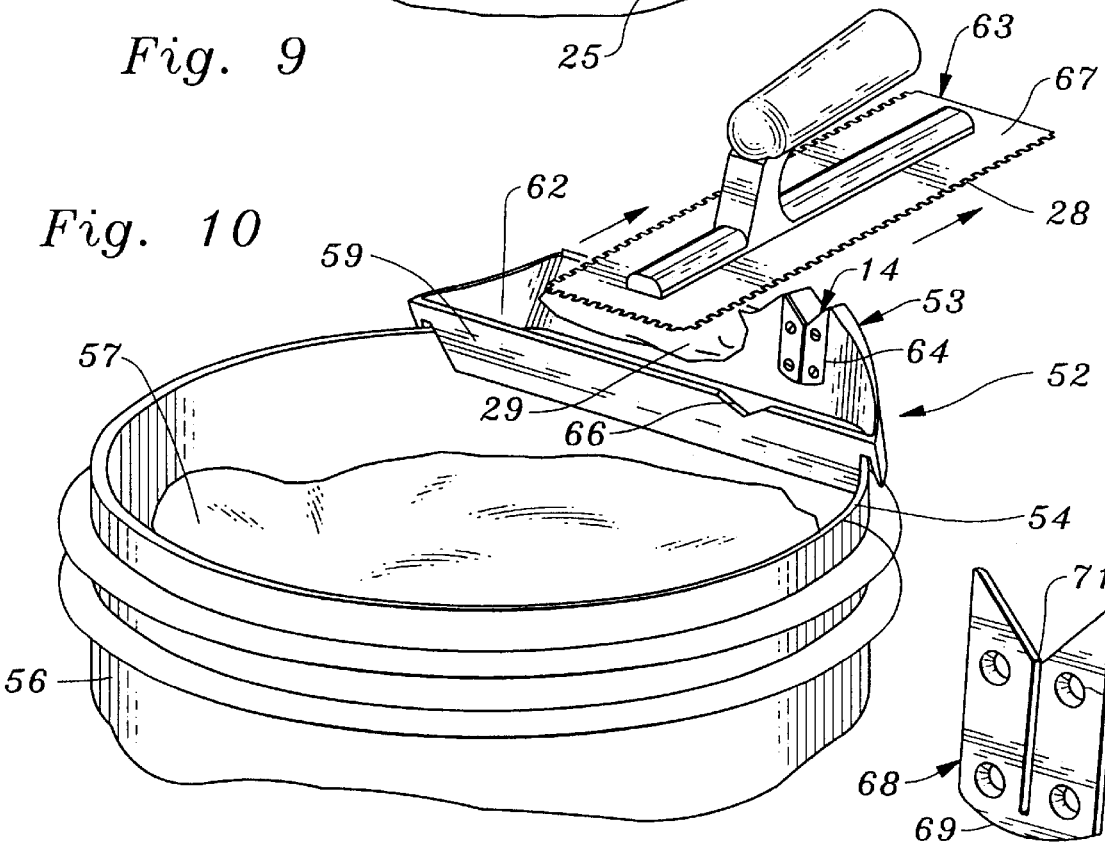
FIG. 10 is a perspective view of the combination of FIG. 9, but with the lower face of the trowel being drawn across the cleaning blade; and, FIG. 11 is a perspective view of a unitary cleaning blade construction.

Accordingly, when it is time to remove contaminated or old adhesive 29 from the trowel 63, trowel blade 67 is lowered into the slot, with the rear end of the blade 67 in the entry side 16 of the slot. Gripping the accessory 52 or the attached bucket 56 for stability, the installer draws the trowel blade 67 through the cleaning blades 64, as shown in FIG. 9.

The cleaning blades 64 scrape the old adhesive 29 from either face of the blade, and the bottom portion of the slot 14 scrapes debris from the trowel notches 28. The debris and old adhesive fall into the reservoir 62, located beneath slot 14. In that manner, the debris and old adhesive are confined and prevented from contaminating the fresh adhesive 57. Since base 53 is preferably manufactured from plastic, a sacrificial rod 30 as described in the first embodiment, is not necessary within slot 14 to protect the teeth from undue wear.

An elongated, horizontally oriented scraper blade 68 is also secured within base 53. This upwardly facing blade is provided as an alternative means of cleaning primarily the bottom face of trowel blade 67. The installer simply places the bottom face of the rear end of the trowel blade over the scraping blade, and draws the trowel away from the accessory 52 (see, FIG. 10). As the adhesive 29 is removed from the trowel blade, it falls into the reservoir 62, where it is collected. In this manner, the trowel 67 may be cleaned in two different ways without contaminating the fresh adhesive 57 remaining in the bucket.

Figure 11:
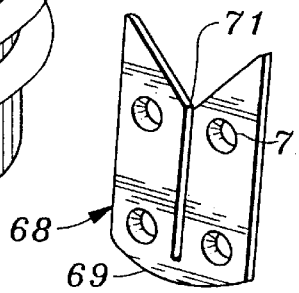

An alternative unitary cleaning blade 68 is shown in FIG. 11. Blade 68 includes a web portion 69, connecting the two sides of the blade. A slit 71 is provided in the blade, having opposing lateral edges, arranged in spaced, parallel relation. The width, or transverse dimension of the slit is such that the slit edges slidably engage the lateral edge of a trowel. Accordingly, the unitary cleaning blade 68 displays structural and functional equivalency with cleaning blades 18 and cleaning blades 64. Blade 68 may directly be substituted and used in lieu of blades 64; and, with slight modifications, blade 68 may also replace cleaning blades 18. Although it lacks the adjustment capabilities of cleaning blades 18, blade 68 provides an inexpensive and simple alternative cleaning blade, for use with either embodiment of the present invention.

It will be appreciated, then, that I have disclosed herein two embodiments of an apparatus for cleaning trowel blades, one comprising a handtool which may also be combined with a trowel blade to provide a subfloor cleaning capability, and the other comprising a convenient accessory for attachment to the lip of an adhesive bucket.

What is claimed is:

1. An apparatus for cleaning adhesive and debris from an edge of a trowel blade having a thickness, comprising:

a. a body having an elongated slot extending through at least a portion of said body, said slot having a blade entry side, a blade exit side, and a lower edge extending therebetween; and, b. a pair of opposing, co-planar, cleaning blades rigidly mounted on said entry side, on either side of said slot, said blades being arranged in spaced relation a distance slightly greater than the thickness of the trowel blade.

2. An apparatus as in claim 1 including a handle extending from said body.

3. An apparatus as in claim 1, including a cleaning trowel blade and means for detachably coupling said cleaning trowel blade to said body.

4. An apparatus as in claim 3, in which said means for detachably coupling includes a groove extending from a forward end to a rearward end of a bottom portion on said body, and a bar extending along an upper face of said cleaning trowel blade, said groove being sized and configured to accommodate said bar.

5. An apparatus as in claim 4 further including means for selectively securing said body, at any position along said bar.

6. An apparatus as in claim 3 in which said cleaning trowel blade has a forward end and a knife mounted on said forward end.

7. An apparatus as in claim 3 in which said cleaning trowel blade has forward lateral edges, and at least one arcuate cutout within one of said lateral edges.

8. An apparatus as in claim 1 including a second pair of opposing parallel cleaning blades mounted on said exit side of said notch, said blades being arranged in spaced relation a distance slightly greater than the thickness of the trowel blade.

9. An apparatus as in claim 1 in which said body has a flat bottom portion, and in which said slot defines a plane which is oblique with respect to said flat bottom portion.

10. An apparatus as in claim 1 in which said lower edge of said slot includes a plastic rod, said rod having an upper portion slightly above said lower edge, along which a lateral edge of the trowel slides.

11. An apparatus as in claim 1 in which the distance between said cleaning blades is adjustable.

12. An apparatus as in claim 1 in which said entry side defines a plane which is oblique with respect to a plane of said lower edge of said slot.

13. An apparatus as in claim 1, wherein said body includes a periphery having an arcuate portion extending partly around an upper rim of a bucket, and a lineal portion connecting ends of said arcuate portion, and further including a semi-circular groove beneath and coextensive with said arcuate portion, said groove being sized and configured to accommodate a corresponding section of the rim, whereby said body is temporarily attached to the bucket rim.

14. An accessory for cleaning adhesive and debris from an edge of a trowel blade, comprising:

a. a body having an elongated slot extending through at least a portion of said body, said slot having a blade edge entry side, a blade edge exit side, and a lower edge extending therebetween;

b. means on said entry side of said slot, for scraping adhesive and debris from the edge of the trowel;

c. a bucket containing adhesive, said bucket having an upper rim; and, d. means for mounting said body onto said upper rim.

15. An accessory as in claim 14 further including a well within said body, said well having an open portion positioned beneath said entry side of said slot.

16. An accessory as in claim 15, further including a scraper blade on an upper surface of said body, and in which said well has an open portion positioned beneath said scraper blade.

17. An accessory as in claim 14 further including a V-shaped notch having a bottom edge in co-planar alignment with said slot.

18. An accessory as in claim 14 further including an elongated, horizontally oriented scraper blade, on an upper surface of said body.

19. An apparatus for cleaning adhesive and debris from an edge of a trowel blade having a thickness, comprising:

a. a body having an elongated slot extending through at least a portion of said body, said slot having a blade entry side, a blade exit side, and a lower edge extending therebetween; and, b. a cleaning blade mounted on said entry side of said slot, said blade including a slit having a transverse dimension slightly greater than the thickness of the trowel blade, and said slit being positioned in co-planar relation with respect to said slot.

20. An apparatus as in claim 19 including a handle extending from said body.

21. An apparatus as in claim 19, including a cleaning trowel blade and means for detachably coupling said cleaning trowel blade to said body.

22. An apparatus as in claim 21, in which said means for detachably coupling includes a groove extending from a forward end to a rearward end of a bottom portion on said body, and a bar extending along an upper face of said cleaning trowel blade, said groove being sized and configured to accommodate said bar.

23. An apparatus as in claim 22 further including means for selectively securing said body, at any position along said bar.

24. An apparatus as in claim 21 in which said cleaning trowel blade has a forward end and a knife mounted on said forward end.

25. An apparatus as in claim 21 in which said cleaning trowel blade has forward lateral edges, and at least one arcuate cutout within one of said lateral edges.

26. An apparatus as in claim 19 in which said body has a flat bottom portion, and in which said slot defines a plane which is oblique with respect to said flat bottom portion.

27. An apparatus as in claim 19 in which said lower edge of said slot includes a plastic rod, said rod having an upper portion slightly above said lower edge, along which a lateral edge of the trowel slides.

28. An apparatus as in claim 19 in which said entry side defines a plane which is oblique with respect to a plane of said lower edge of said slot.

29. An apparatus for cleaning adhesive and debris from an edge of a trowel blade having a thickness, comprising:

a. a body having an elongated slot extending through at least a portion of said body, said slot having a blade entry side, a blade exit side, and a lower edge extending therebetween, said body including a periphery having an arcuate portion extending partly around an upper rim of a bucket, and a lineal portion connecting ends of said arcuate portion, and further including a semi-circular groove beneath and coextensive with said arcuate portion, said groove being sized and configured to accommodate a corresponding section of the rim, allowing temporary attachment of said body to the bucket rim;

and, b. a pair of opposing, parallel, cleaning blades mounted on said entry side of said slot, said blades being arranged in spaced relation a distance slightly greater than the thickness of the trowel blade.

30. An apparatus as in claim 29 further including a well within said body, said well having an open portion positioned beneath said entry side of said slot.

31. An apparatus as in claim 28, further including a scraper blade on an upper surface of said body, and in which said well has an open portion positioned beneath said scraper blade.

32. An apparatus as in claim 29 further including a V-shaped notch having a bottom edge in co-planar alignment with said slot.

33. An apparatus as in claim 29 further including an elongated, horizontally oriented scraper blade, on an upper surface of said body.

34. An apparatus as in claim 29 in which said body covers only a portion of an open end of the bucket defined by the upper rim.

35. A handtool for cleaning adhesive and debris from an edge of a trowel blade, comprising:

a. a body having an elongated slot extending through at least a portion of said body, said slot having a blade edge entry side, a blade edge exit side, and a lower edge extending therebetween;

b. a cleaning blade mounted on said entry side of said slot, said blade including a slit having a transverse dimension slightly greater than the thickness of the trowel blade, and said slit being positioned in co-planar relation with respect to said slot; and, c. a handle extending from said body.

* * * * *